US005934932A

United States Patent [19]

Ito

[11] Patent Number: 5,934,932

[45] **Date of Patent: *Aug. 10, 1999**

[54] ELECTRICAL CONNECTOR FOR FLAT CABLES

[75] Inventor: Tomoaki Ito, Machida, Japan

[73] Assignee: Molex Incorporated, Lisle, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,312

[22] Filed: Mar. 3, 1997

[30] Foreign Application Priority Data

Jun. 21, 1996 [JP] Japan ..... 8-181156

[51] Int. Cl.[6] ..... H01R 23/66

[52] U.S. Cl. ..... 439/495

[58] Field of Search ..... 439/495, 492, 439/493, 499, 260, 67, 77, 326, 329, 497, 660, 667, 341

[56] References Cited

U.S. PATENT DOCUMENTS

| | | | |
|---|---|---|---|
| 3,084,302 | 4/1963 | Braeutigam | 339/17 |
| 3,696,319 | 10/1972 | Olsson | 339/17 F |
| 4,477,137 | 10/1984 | Ayer | 339/59 M |
| 4,629,271 | 12/1986 | Awano | 339/75 MP |
| 4,630,874 | 12/1986 | Renn et al. | 339/17 F |
| 4,639,063 | 1/1987 | Mueller | 339/75 M |
| 4,640,562 | 2/1987 | Shoemaker | 339/17 F |
| 4,647,131 | 3/1987 | Van Woensel | 339/74 R |
| 4,695,108 | 9/1987 | Ichitsubo | 439/59 |
| 4,713,020 | 12/1987 | Awano et al. | 439/495 |
| 4,734,053 | 3/1988 | Imai | 439/329 |
| 4,778,403 | 10/1988 | Ikesugi et al. | 439/329 |
| 4,936,792 | 6/1990 | Onoue et al. | 439/329 |
| 4,944,690 | 7/1990 | Imai | 439/492 |
| 5,194,017 | 3/1993 | Consoli | 439/492 |
| 5,397,247 | 3/1995 | Aoki et al. | 439/496 |
| 5,458,506 | 10/1995 | Yamaguchi et al. | 439/495 |
| 5,695,359 | 12/1997 | Fujikura et al. | 439/495 |

FOREIGN PATENT DOCUMENTS

| | | | |
|---|---|---|---|
| 4-11346 | 3/1992 | Japan | H01R 9/07 |

*Primary Examiner*—Paula Bradley
*Assistant Examiner*—Tho D. Ta
*Attorney, Agent, or Firm*—Stephen Z. Weiss

[57] ABSTRACT

An electrical connector is adapted for terminating a flat cable. The connector includes an elongated dielectric housing defining an elongated opening for receiving a flat electrical cable. A plurality of terminals are mounted on the housing and have contact portions spaced along the opening. An actuator is mounted on the housing for movement between a first position allowing free insertion of the flat cable into the opening and a second position wherein a pressure plate of the actuator biases the cable against the contact portions of the terminals. The actuator includes at least one narrow projection at a leading edge of the pressure plate for preliminarily engaging a narrow portion of the flat cable to bias the cable against only some of the contact portions before the actuator is fully moved to its second position.

12 Claims, 5 Drawing Sheets

ELECTRICAL CONNECTOR FOR FLAT CABLES

FIELD OF THE INVENTION

This invention generally relates to the art of electrical connectors and, particularly, to an electrical connector for terminating a flat cable, such as the end of a flat flexible cable.

BACKGROUND OF THE INVENTION

There are a wide variety of zero insertion force electrical connectors particularly adapted for terminating flat cables, such as flexible flat cables, flexible printed circuit boards and the like. These electrical connectors conventionally have a housing mounting a plurality of terminals in a generally parallel array spaced along an elongated opening or slot for receiving an end of the flat cable. Typically, these connectors use actuators to push the flexible flat cables, flexible printed circuit boards or the like against resilient contact portions of the terminals.

The actuators of these flat cable connectors typically are movable between a first position allowing free insertion of the flat cable into the elongated opening or slot in the housing, and a second position wherein a pressure plate of the actuator biases the cable against the contact portions of the terminals. For instance, the end of the flat cable may be stripped of its insulation so that the pressure plate biases exposed conductors of the cable against the contact portions of the terminal.

One of the ever-increasing problems with flat cable connectors of the character described above, involves manually manipulating the housing, the actuator and the cable to terminate the cable. Simply put, there are three components that must be manipulated, and the operator has only two hands. This problem is becoming more prominent with the ever-increasing elongation of such connectors to accommodate more and more terminals. In other words, to carry out a termination operation, the operator must hold the connector with one hand and insert and hold the cable with the other hand, while using one or both of the hands to move the actuator while the cable is still being held in the opening or slot of the housing. Quite often, the cable moves or shifts while the actuator is being moved, resulting in an inadequate or defective termination. It can be understood that this problem is magnified as the connectors become longer to accommodate more terminals. The present invention is directed to solving these problems.

SUMMARY OF THE INVENTION

An object, therefore, of the invention is to provide a new and improved electrical connector for a flat cable.

In the exemplary embodiment of the invention, the connector includes an elongated dielectric housing defining an elongated opening for receiving a flat electrical cable. A plurality of terminals are mounted on the housing and have contact portions spaced along the opening. An actuator is mounted on the housing for movement between a first position allowing free insertion of the flat cable into the opening and a second position wherein a pressure plate of the actuator biases the cable against the contact portions of the terminals. At least one narrow projection is provided at a leading end of the pressure plate for preliminarily engaging a narrow portion of the flat cable to bias the cable against only some of the contact portions before the actuator is fully moved to its second position. In essence, the narrow projection temporarily holds the cable while the operator is able to apply full force to the actuator to terminate the entire cable.

Preferably, a plurality of the narrow projections are spaced along the pressure plate longitudinally of the cable-receiving opening. Two of the narrow projections are located near opposite ends of the pressure plate for engaging narrow portions of the flat cable near opposite edges of the cable. This prevents the cable from skewing in the opening. The actuator is designed herein as a one-piece structure, with the narrow projections being integral with the leading end of the pressure plate.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
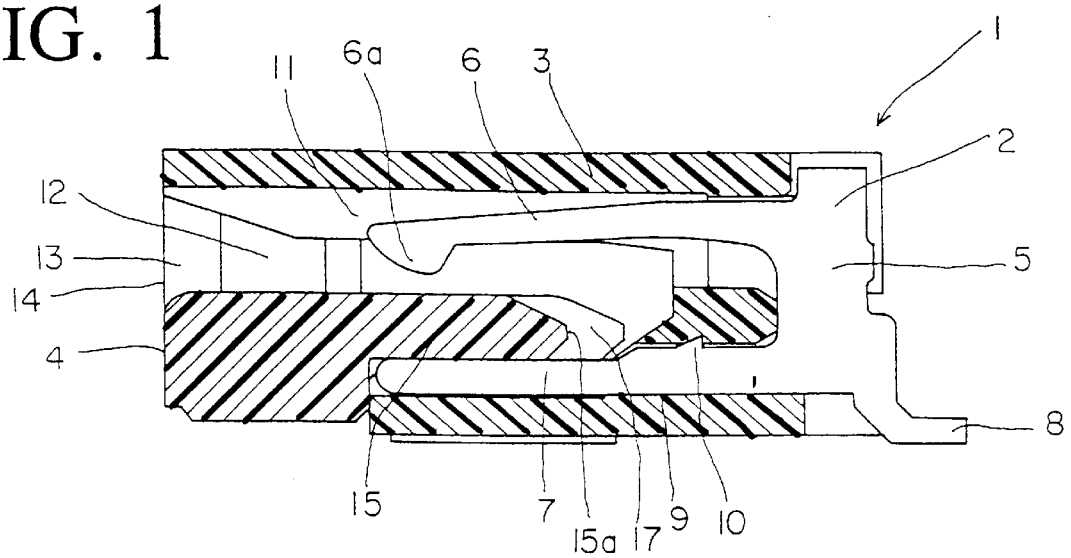
FIG. 1 is a front-to-rear section through an electrical connector according to a first embodiment of the invention, with the actuator in its second or fully inserted position.
Figure 2:
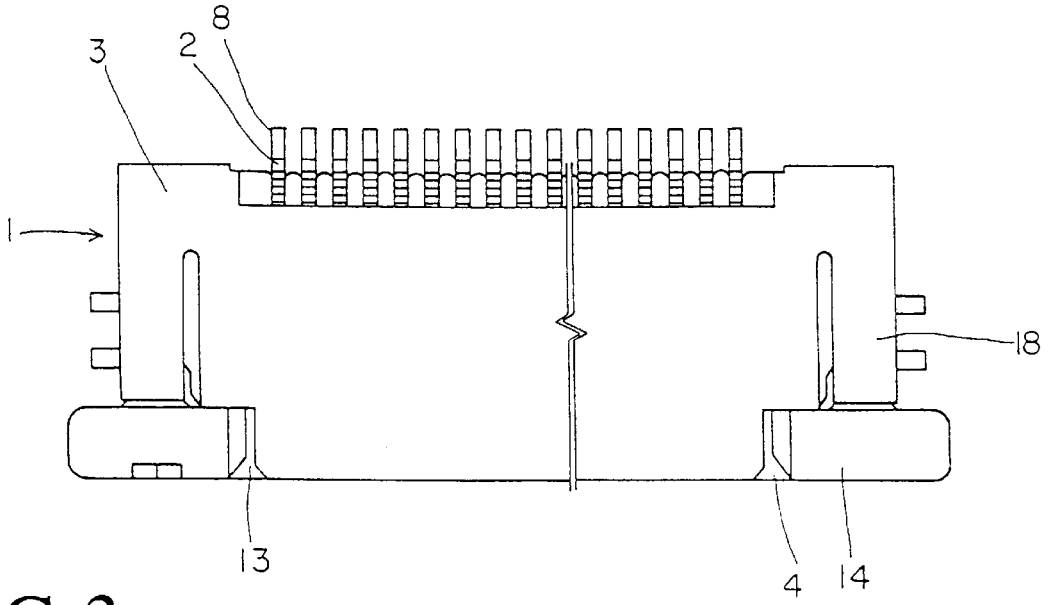
FIG. 2 is a fragmented top plan view of the connector.
Figure 3:
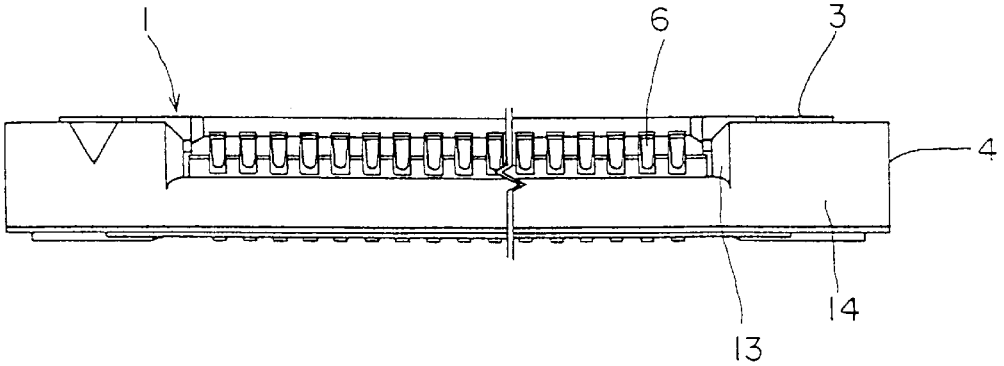
FIG. 3 is a fragmented front elevational view of the connector.

Referring to the drawings in greater detail, and first to FIGS. 1–4, an electrical connector, generally designated 1, is shown according to a first embodiment of the invention. The connector includes a plurality of terminals 2 arranged in a parallel array at regular intervals within a housing 3. An actuator 4 is slidably mounted to housing 3. The housing is a one-piece structure integrally molded of dielectric material such as plastic or the like. The terminals are stamped and formed of conductive sheet metal material, with each terminal being in a bifurcated form as seen in FIG. 1.

Specifically, each terminal 2 has a resilient contact arm 6 and a fixed base arm 7 integrally joined to and extending forwardly from a bight portion 5. Each terminal has an L-shaped tail portion for surface mounting to a circuit trace on a printed circuit board, as by soldering. The terminals are mounted to the housing by press-fitting the terminals into the rear side (the right-hand side as viewed in FIG. 2) of housing 3. Fixed base arms 7 of the terminals are inserted into holes 9 in the housing, and barbs 10 of the terminals dig into the plastic material of the housing to fix the terminals in position. When so positioned as shown in FIG. 1, contact arms 6 extend in a cantilevered fashion so that contact portions 6*a* of the resilient contact arms are located in a cable insertion cavity 11.

Figure 4:
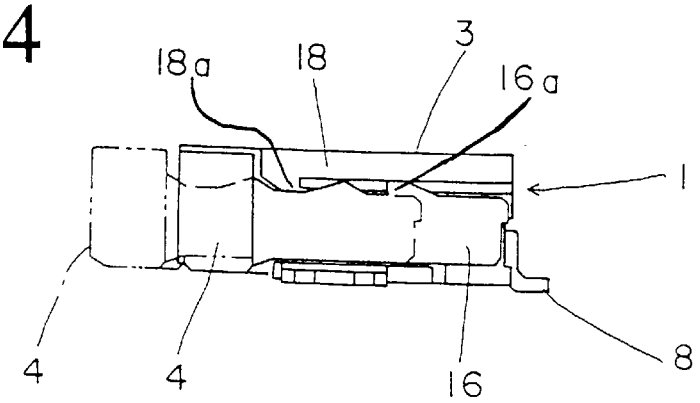
FIG. 4 is an end elevational view of the connector.
Figure 5:
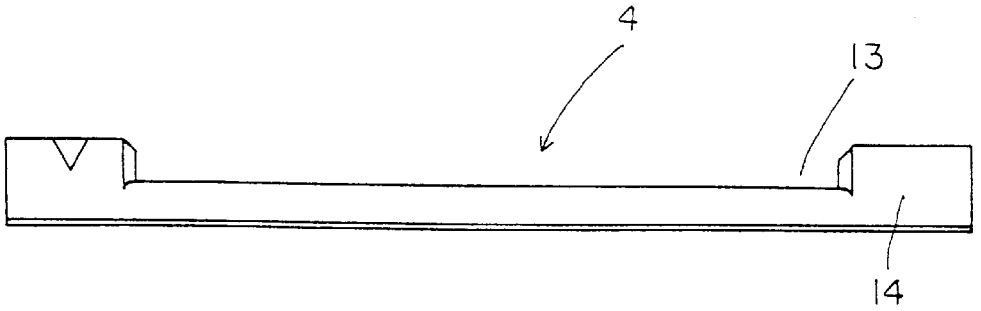
FIG. 5 is a front elevational view of the actuator of the connector.

Referring to FIGS. 5–8 in conjunction with FIGS. 1–4, actuator 4 has a flat rectangular pressure plate 15 insertable into cable-insertion cavity 11 of housing 3. The actuator has two side walls or extensions 16 integral with pressure plate 15 at opposite sides or ends of the pressure plate. Extensions 16 project beyond the pressure plate and are adapted for mounting actuator 4 to opposite sides of dielectric housing 3. The extensions project from end portions 14 of the actuator. As seen in FIG. 4, housing 3 has two side arms 18 which function as stop arms for engaging extensions 16. Extensions 16 have latches 16*a* and arms 18 have latches 18*a* for mounting the actuator on the housing and holding the actuator at least in a first, inoperative position as shown in phantom in FIG. 4.

Figure 6:
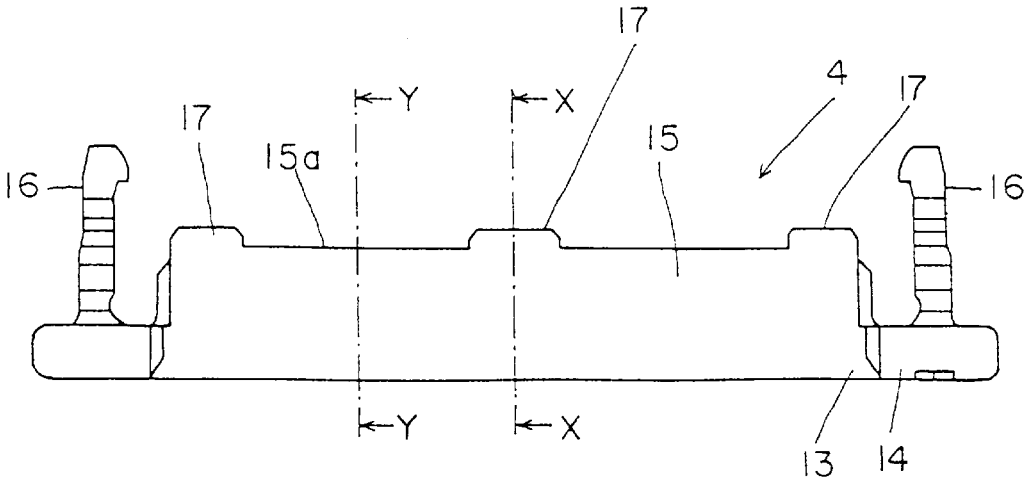
FIG. 6 is a top plan view of the actuator.
Figure 7:
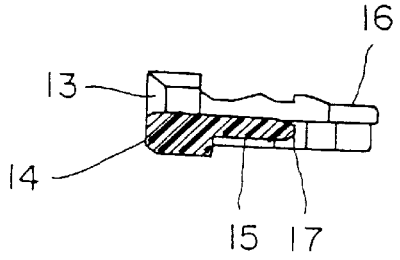
FIG. 7 is a section taken generally along line X—X in FIG. 6.
Figure 8:
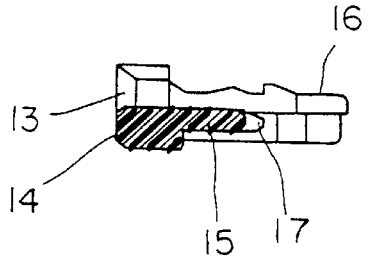
FIG. 8 is a section taken generally along Y—Y in FIG. 6.

As seen best in FIG. 6, a plurality of narrow projections 17 extend inwardly of a leading edge 15*a* of pressure plate 15. These narrow projections are used to temporarily hold the flat cable prior to full termination of the cable, as will be described in greater detail hereinafter.

In operation of actuator 4, pressure plate 15 of the actuator faces contact portions 6*a* of resilient contact arms 6 of terminals 2 as seen in FIG. 1. The actuator is movable from a first position shown in phantom in FIG. 4 allowing free insertion of the flat cable into cable-insertion cavity 11, to a second position shown in FIG. 1 and in full lines in FIG. 4. In the second position, pressure plate 15 is effective to bias the stripped end of the flat flexible cable against contact portions 6*a* of resilient contact arms 6 of the terminals.

Figure 9:
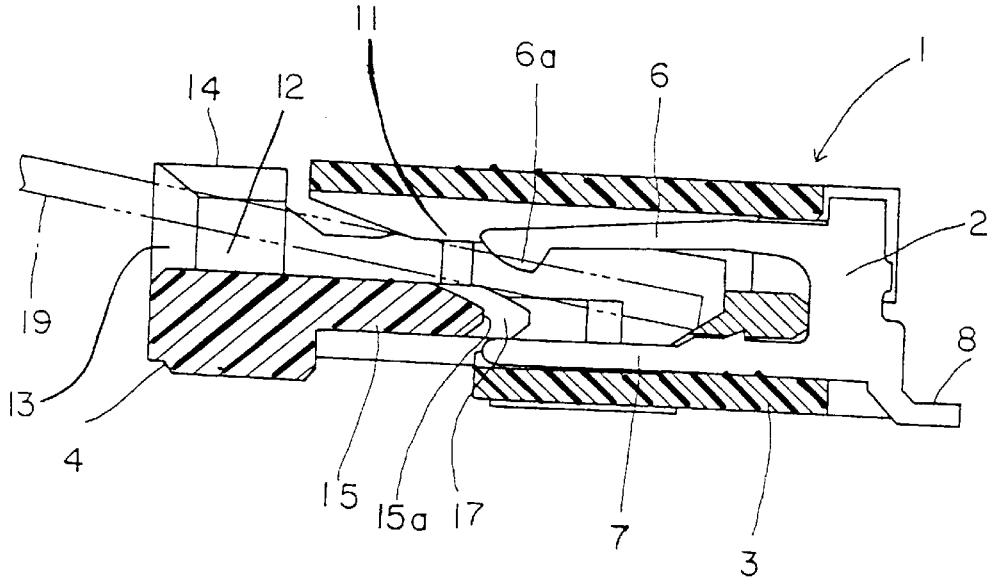
FIG. 9 is a view similar to that of FIG. 1, but with the actuator in its first position allowing free insertion of the flat cable which is shown in phantom.
Figure 10:
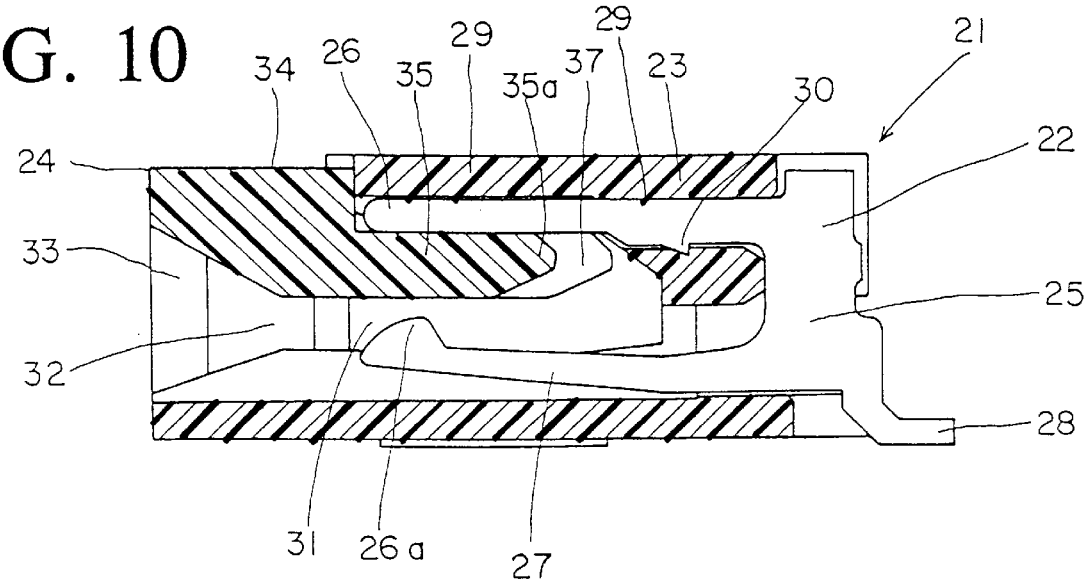
FIG. 10 is a view similar to that of FIG. 1, but of a second embodiment of an electrical connector according to the invention.
Figure 11:
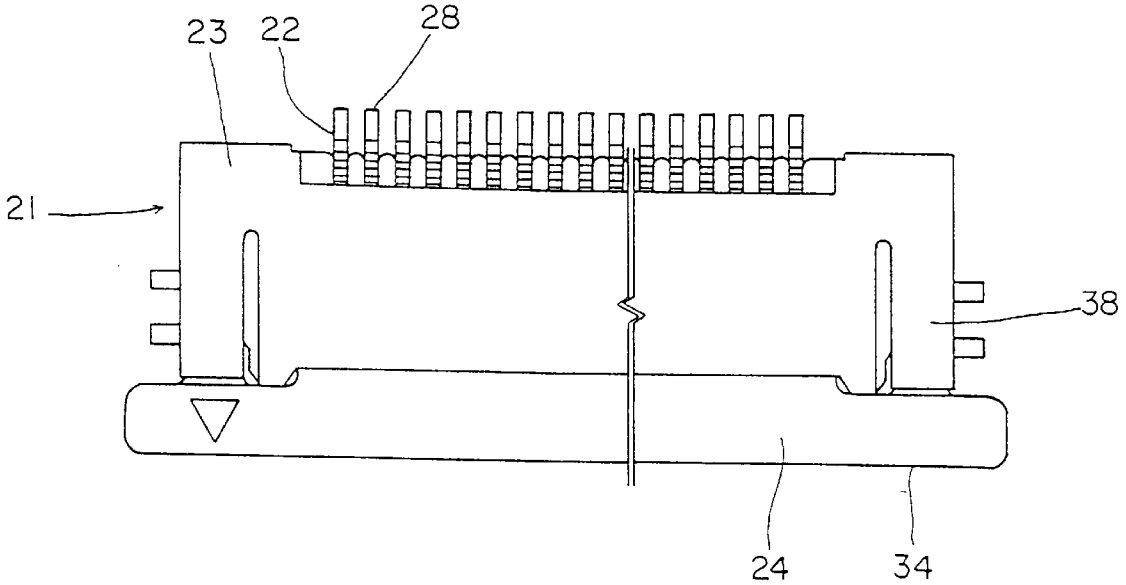
FIG. 11 is a fragmented top plan view of the connector of FIG. 10.
Figure 12:
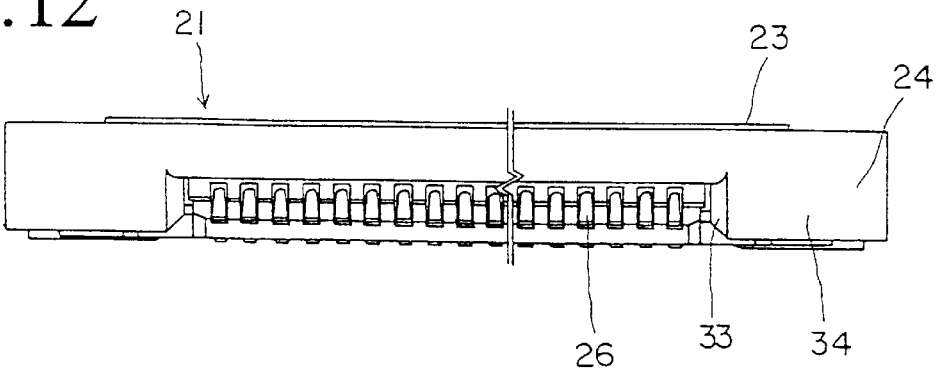
FIG. 12 is a fragmented front elevational view of the connector of FIG. 10.
Figure 13:
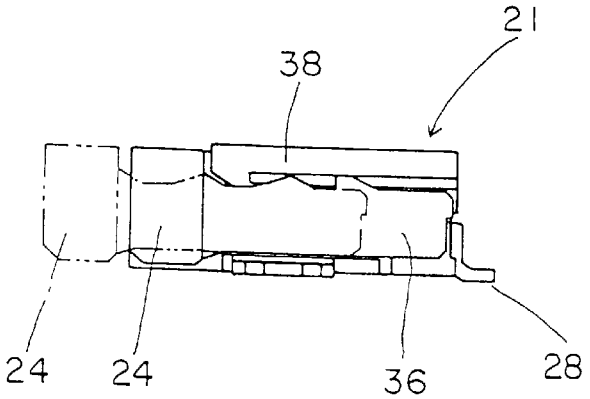
FIG. 13 is an end elevational view of the connector of FIG. 10.

FIG. 9 shows how a flat flexible cable 19 is inserted into the connector. First, actuator 4 is moved to its first or inoperative position as shown in FIG. 9. The front stripped end of the flat flexible cable is inserted through opening 12 between side portions 14 of the actuator and into cable-insertion cavity 11 of housing 3. Angled sides 13 of opening 12 guide the stripped end of the flat flexible cable. As the cable is inserted into the connector as shown in FIG. 9, only narrow projections 17 at the leading edge 15*a* of pressure plate 15 engage narrow portions of the flat cable to bias the cable against only some of the contact portions 6*a* of only some of the resilient contact arms 6. Only a relative amount of insertion force is required. In other words, no substantial insertion force is required to push flat flexible cable 19 past only a few of the contact portions 6*a* and to the fully inserted position of the cable as shown in FIG. 9, because narrow projections 17 engage only selected short widths of the cable rather than the full lateral width of the cable. However, the force is sufficient to temporarily hold the cable while the operator can manipulate actuator 4 to push the actuator to its second or final position as shown in FIG. 1. When the actuator is pushed to its final position, the full lateral width of pressure plate 15 biases the flat flexible cable against all of the contact portions 6*a* of resilient contact arms 6 of the terminal. Therefore, the operator can use both hands in connecting the cable to the connector which facilitates handling a rather elongated connector having an increased number of terminals and corresponding conductors of the cable.

FIGS. 10–14 show a second embodiment of an electrical connector, generally designated 21, according to the invention. The same parts as described above in relation to the first embodiment of FIGS. 1–9 are indicated by reference numerals in FIGS. 10–14 by adding "twenty (20)" to the reference numerals indicating the same parts as in the first embodiment, and detailed description of those same or similar parts are not repeated. Suffice it to say, a plurality of terminals 22 each includes a fixed base arm 27, a resilient contact arm 26 joined to the base arm by a bight portion 25. The actuator 24 has an angled mouth 33 leading to an opening 32, and the actuator includes a pressure plate 35. As in the first embodiment, narrow projections 37 project from the leading edge 35*a* of pressure plate 35.

Figure 14:
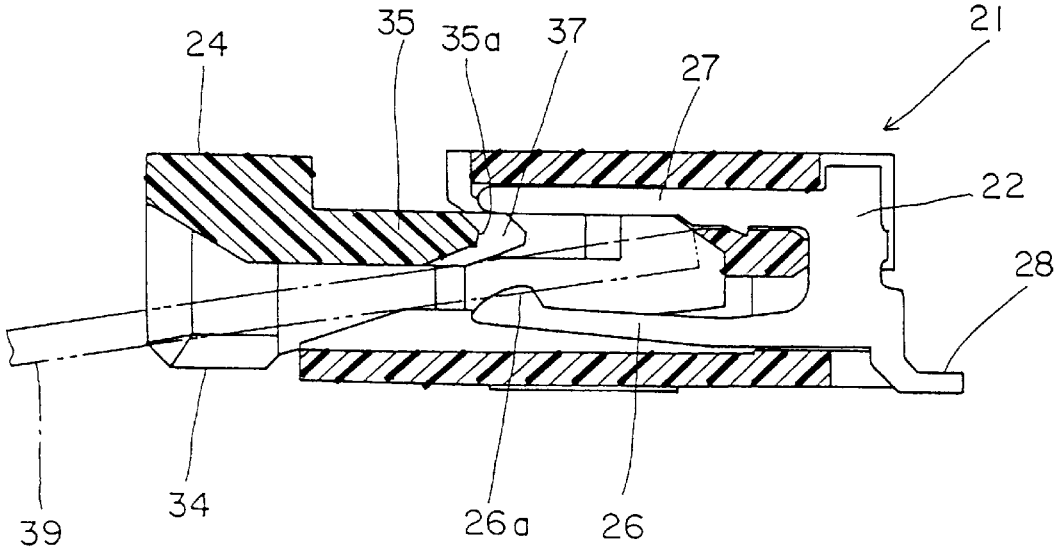
FIG. 14 is a view similar to that of FIG. 10, but with the actuator in its first position allowing free insertion of the flat cable which is shown in phantom.

FIG. 14 shows actuator 24 in its first or inoperative position allowing free insertion of flat flexible cable 39. When the cable is inserted, the stripped end of the cable engages only narrow projections 37 at the leading edge 35*a* of pressure plate 35 and is biased against only some of the contact portions 26*a* of only some of the resilient contact arms 6. This requires minimal insertion force, only sufficient to temporarily hold the cable so that the operator can manipulate actuator 24 and push the actuator to its second, fully operative position shown in FIG. 10. During movement toward its final position, the full width of pressure plate 35 biases the full width of flat flexible cable 39 against all of the contact portions 26*a* of all of the resilient contact arms 6.

As with the first embodiment, once the stripped end of cable 39 has been inserted, it is tentatively held between the contact portions 26*a* of resilient contact arms 26 only at narrow projections 37. This requires no substantial force. With the cable being tentatively held, the operator then can advantageously use both hands to fully move the actuator and completely terminate the cable in the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for a flat cable, comprising:

an elongated dielectric housing defining an elongated opening for receiving a flat electrical cable, with a plurality of terminals mounted on the housing and having an in line row of contact portions spaced along the opening; and an actuator mounted on the housing for movement between a first position allowing free insertion of the flat cable into the opening and a second position wherein a pressure plate of the actuator biases the cable against the contact portions of all of the terminals, and including at least one narrow projection at a leading end of the pressure plate for preliminarily engaging a narrow portion of the flat cable to bias the cable against only the contact portions in said in line row which are opposite the at least one narrow projection, the cable being free of being biased against the contact portions of most of the plurality of terminals in said in line row on each side of the at least one narrow projection before the actuator is fully moved to its second position.

2. The electrical connector of claim 1, including a plurality of said narrow projections spaced along the pressure plate longitudinally of the opening.

3. The electrical connector of claim 2 wherein two of said narrow projections are located near opposite ends of the pressure plate for engaging narrow portions of the flat cable near opposite edges of the cable.

4. The electrical connector of claim 1 wherein said actuator comprises a one-piece structure, with said narrow projection being integral with the leading end of the pressure plate.

5. The electrical connector of claim 4, including a plurality of said narrow projections spaced along the pressure plate longitudinally of the opening.

6. The electrical connector of claim 5 wherein two of said narrow projections are located near opposite ends of the pressure plate for engaging narrow portions of the flat cable near opposite edges of the cable.

7. An electrical connector for flat cable, comprising:

an elongated dielectric housing defining an elongated opening for receiving a flat electrical cable, with a plurality of terminals mounted on the housing and having an in line row of contact portions spaced along the opening; and an actuator mounted on the housing for movement between a first position allowing free insertion of the flat cable into the opening and a second position biasing the cable against the contact portions of all of the terminals, the actuator including at least one narrow projection at a leading end of the actuator for tentatively engaging a narrow portion of the flat cable to bias the cable against only the contact portions in said in line row which are opposite the at least one narrow projection, the cable being free of being biased against the contact portions of most of the plurality of terminals in said in line row on each side of the at least one narrow projection before the actuator is fully moved to its second position.

8. The electrical connector of claim 7, including a plurality of said narrow projections spaced along the actuator longitudinally of the opening.

9. The electrical connector of claim 8 wherein two of said narrow projections are located near opposite ends of the actuator for engaging narrow portions of the flat cable near opposite edges of the cable.

10. The electrical connector of claim 7 wherein said actuator comprises a one-piece structure, with said narrow projection being integral with a leading end thereof.

11. The electrical connector of claim 10, including a plurality of said narrow projections spaced along the actuator longitudinally of the opening.

12. The electrical connector of claim 11 wherein two of said narrow projections are located near opposite ends of the actuator for engaging narrow portions of the flat cable near opposite edges of the cable.

* * * * *